US010822726B2

(12) United States Patent
Kuebler et al.

(10) Patent No.: US 10,822,726 B2
(45) Date of Patent: Nov. 3, 2020

(54) OPENING ROLLER FOR AN OPEN-END SPINNING DEVICE, AND OPEN-END SPINNING DEVICE WITH THE OPENING ROLLER

(71) Applicant: Maschinenfabrik Rieter AG, Winterthur (CH)

(72) Inventors: Markus Kuebler, Geislingen (DE); Constantin Rieger, Gingen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 40 days.

(21) Appl. No.: 16/211,691

(22) Filed: Dec. 6, 2018

(65) Prior Publication Data

US 2019/0177883 A1 Jun. 13, 2019

(30) Foreign Application Priority Data

Dec. 7, 2017 (DE) ..... 10 2017 129 152

(51) Int. Cl.
*D01H 4/32* (2006.01)
*D01G 9/22* (2006.01)

(52) U.S. Cl.
CPC ..... *D01H 4/32* (2013.01); *D01G 9/22* (2013.01)

(58) Field of Classification Search
CPC ..... D01H 4/08–14; D01H 4/32; D01G 9/22
See application file for complete search history.

(56) References Cited

U.S. PATENT DOCUMENTS 2,750,828 A * 6/1956 Wendling ..... B25B 13/06 81/125
5,261,221 A * 11/1993 Stahlecker ..... D01H 4/12 384/243
5,293,921 A * 3/1994 Marocco ..... E06B 9/307 160/176.1 R
5,318,497 A * 6/1994 Aarnink ..... D01H 4/32 19/112
5,419,111 A 5/1995 Wassenhoven et al.
5,509,261 A * 4/1996 Wassenhoven ..... D01H 4/32 57/100
5,555,715 A * 9/1996 Paweletz ..... D01H 4/10 310/86
5,634,326 A * 6/1997 Wanger ..... D01H 4/12 57/406
5,689,946 A * 11/1997 Schmid ..... D01H 4/32 19/115 R (Continued)

FOREIGN PATENT DOCUMENTS

DE 24 41 846 A1 3/1976
DE 43 09 947 A1 9/1994

(Continued)

OTHER PUBLICATIONS

EP Search Report, dated May 16, 2019.
German Patent Office Search Report, dated Sep. 20, 2018.

*Primary Examiner* — Shaun R Hurley
(74) *Attorney, Agent, or Firm* — Dority & Manning, P.A.

(57) ABSTRACT

An opening roller for an open-end spinning device includes a drive shaft and a roller body connected to the drive shaft. The drive shaft includes a coupling element for connection to a driven shaft of a drive. The coupling element includes a form-locking element. An open-end spinning device is also provided that incorporates the opening roller.

14 Claims, 4 Drawing Sheets

(56) References Cited

U.S. PATENT DOCUMENTS

| | | | | |
|---|---|---|---|---|
| 5,709,074 | A * | 1/1998 | Stahlecker | D01H 4/32 19/112 |
| 5,768,880 | A * | 6/1998 | Schmid | D01H 4/32 19/115 R |
| 5,802,838 | A * | 9/1998 | Bock | D01H 4/10 57/406 |
| 5,946,899 | A * | 9/1999 | Wassenhoven | D01H 4/32 57/301 |
| 5,967,693 | A * | 10/1999 | Braaten | E21B 17/03 403/383 |
| 6,863,466 | B2 * | 3/2005 | Buhren | D01H 4/10 403/383 |
| 7,605,509 | B2 * | 10/2009 | Buhren | D01H 4/14 310/156.08 |
| 8,210,766 | B2 * | 7/2012 | Schermer | D01H 4/32 19/112 |
| 8,490,376 | B2 * | 7/2013 | Schermer | D01H 4/32 57/412 |
| 9,127,513 | B2 * | 9/2015 | Matthias | E21B 17/22 |
| 9,328,758 | B2 * | 5/2016 | Schermer | D01H 4/32 |
| 9,689,090 | B2 * | 6/2017 | Loos | D01H 4/10 |
| 2002/0006830 | A1 * | 1/2002 | Buhren | D01H 4/10 464/29 |
| 2009/0038576 | A1 * | 2/2009 | Schermer | D01H 4/32 123/193.2 |
| 2009/0084081 | A1 * | 4/2009 | Wassenhoven | D01H 4/10 57/404 |
| 2013/0189029 | A1 * | 7/2013 | Schermer | F16B 17/00 403/349 |
| 2018/0142736 | A1 * | 5/2018 | Kuebler | F16D 1/116 |

FOREIGN PATENT DOCUMENTS

| | | |
|---|---|---|
| DE | 196 50 597 A1 | 6/1998 |
| DE | 10 2016 102 151 A1 | 8/2017 |
| EP | 0 192 407 A2 | 8/1986 |
| EP | 2 730 686 A1 | 5/2014 |

* cited by examiner

OPENING ROLLER FOR AN OPEN-END SPINNING DEVICE, AND OPEN-END SPINNING DEVICE WITH THE OPENING ROLLER

FIELD OF THE INVENTION

The present invention relates to an opening roller for an open-end spinning device, including a drive shaft and a roller body connected to the drive shaft, wherein the drive shaft includes a coupling element for connection to an driven shaft of a drive, in particular, an electric single drive.

Moreover, the invention relates to an open-end spinning device including an opening roller having a drive shaft and a roller body connected to the drive shaft, and to a drive, in particular, an electric single drive, for the opening roller, with an driven shaft. The drive shaft of the opening roller and the driven shaft of the drive are connected to one another with the aid of a coupling device, wherein the drive shaft of the opening roller includes a coupling element and wherein the driven shaft of the drive includes a coupling piece.

BACKGROUND

The task of an opening roller in an open-end spinning machine is that of opening the sliver supplied to the machine, as starting material, into individual fibers, from which a yarn is subsequently spun. For this purpose, the sliver is guided over the card clothing, which is equipped with teeth, on the surface of the rotating opening roller. Due to friction at the comparatively high rotational speed, the components of the opening rollers are exposed to a high load and high wear and must be replaced or maintained at regular intervals. In addition, during the processing of another starting material, it is often necessary to replace the opening roller with an opening roller suitable for this material. A modern spinning machine generally includes a plurality of spinning devices which, in the past, were jointly driven. Over the course of development of spinning devices that are largely independent of one another, the components, i.e., the opening rollers as well, were equipped with group or single drives. In the case of single drives, the opening rollers were frequently fastened together with their drive motor in the open-end spinning device for design-related reasons and due to spatial limitations, and, therefore, could also only be jointly removed in order to replace the opening roller. Since the drive motor must be electrically disconnected for this purpose, this is correspondingly complex.

For the purpose of performing maintenance on this type of opening roller or the associated drive, DE 10 2016 102 151 A1 describes an opening roller which can be removed from the spinning device together with the rotor of its single drive. The stator of the single drive remains in the spinning device, however. Special drives are required in order to be able to easily remove the rotor from the stator. In addition, there is the risk that the rotor will become damaged. The rotor generally has a longer service life than the opening roller.

DE 43 09 947 A1 describes, for this purpose, a flange connection between the motor shaft and the drive shaft of the opening roller. The disadvantages in this case are a large space requirement of the flange and a complex separation of the connection, for maintenance purposes, by loosening the screws with the aid of the appropriate tool.

The problem addressed by the present invention is therefore that of simplifying the independent maintenance of opening rollers in open-end spinning devices.

SUMMARY

The problem is solved by an opening roller and an open-end spinning device having the features described and claimed herein. Additional objects and advantages of the invention will be set forth in part in the following description, or may be obvious from the description, or may be learned through practice of the invention.

The suggested opening roller for an open-end spinning device includes a drive shaft and a roller body connected thereto, wherein the drive shaft has a coupling element for connection to a driven shaft of a drive. According to the invention, it is provided that the coupling element includes a form-locking element.

Provided there is a similar design of a coupling piece on the driven shaft of the drive, the suggested opening roller is connected to the drive via a form-locking connection, preferably a plug connection. Due to the torque transmission, which is form-locking in this case, slip between the drive and the opening roller is avoided. For maintenance purposes, the connection can be released rapidly and without the use of a tool, which considerably reduces the complexity involved in removing the opening roller. In addition, the independent maintenance of the drive and the opening roller is possible in this way. This is advantageous, in particular, when an electric single drive is utilized.

The coupling piece and the coupling device are also advantageous in other embodiments of drives, for example, group or central drives, however, since every opening roller can be individually removed as a result.

It is particularly advantageous when the form-locking element includes at least one coupling surface which is oriented in the axial direction of the drive shaft and is preferably planar, wherein the form-locking element preferably has a single- or multiple-cornered profile. These types of profiles can transmit high torques and are widely utilized for form-locking elements. Therefore, established manufacturing methods can be utilized for the manufacture of the form-locking element. One example thereof would be a hexagon profile which is widely utilized, for example, for screw heads. According to another advantageous embodiment of the invention, the form-locking element has a multiple-toothed profile. This is particularly well suited for transmitting greater torques as well.

Alternatively, one or multiple bores or appropriate pegs which are eccentric with respect to the rotational axis would also be conceivable for the form-locking element, however. An elliptical profile, for example, would also be possible. The coupling surface of the form-locking element would be curved in this case.

It is also advantageous when the drive shaft of the opening roller is fixedly connected to a bearing unit for supporting the drive shaft in the open-end spinning device. A fixed connection of these two components, i.e., a connection which cannot be released without a tool, allows for a structurally simpler and, therefore, more cost-effective embodiment of the bearing unit. In the case of a fixed connection of the components, therefore, no additional guidance in the bearing unit is necessary and a bearing inner ring can be dispensed with, since the roller bodies can run directly on the drive shaft. In addition, the bearing unit has a similar maintenance interval as other components of the roller body. The amount of additional structural complexity required to ensure a simple separability of the two components would therefore have only limited added value.

It is advantageous in this case when the bearing unit includes a safety groove for a safety element of the open-end spinning device, in particular, for the axial securing of the bearing unit.

Moreover, it is advantageous when the coupling surface of the form-locking element is surface-finished. As a result, wear- and/or corrosion-protection can be achieved, which advantageously affects the service life of the coupling device. Fretting corrosion, in particular, which occurs on coupling surfaces of mechanically loaded components, each of which is metal and at least one of which is ferrous, is prevented in this way. One example of an advantageous surface finishing is hard chrome plating, wherein a chromium layer having a thickness greater than 1 μm is applied onto the surface. Other or additional forms of surface finishing, such as zinc-plating and nickel-plating, would also be conceivable.

It is of additional advantage when the coupling element is a component designed separately from the drive shaft. In particular, a receiving bush inserted into one end of the shaft is advantageous. For example, a receiving bush, as a coupling element, could be bonded, screwed, or clamped into an axially extending borehole introduced into the end of the shaft. If the bush is screwed in, the thread is provided counterdirectional to the direction of rotation of the opening roller. In particular, in the case of a simple shape of the form-locking element, it is also possible, however, to design the form-locking element as one piece with the drive shaft.

Moreover, it is advantageous when the separately designed coupling element can be replaced independently of the drive shaft. As a result, it becomes possible to decouple the maintenance or the replacement of the coupling element, which is exposed to greater wear, from the rest of the opening roller and, thereby, reduce costs.

In addition, it is advantageous when the separately designed coupling element consists of a material which differs from the material of the drive shaft. The requirements on the material properties for the coupling element can differ from those of the drive shaft. The drive shaft of an opening roller usually consists of steel. The coupling element could consist of a cost-effective plastic or a ceramic. As a result, for example, the formation of fretting corrosion on the coupling surfaces of the coupling device is avoided. Bearing metals such as brass or bearing bronze can also be utilized.

The open-end spinning device, which is also provided, includes an opening roller including a drive shaft and a roller body connected to the drive shaft, and a drive for the opening roller including an driven shaft. The drive shaft of the opening roller and the driven shaft of the drive, in particular, a single drive, are connected to one another with the aid of a coupling device. The drive shaft of the opening roller includes, in turn, a coupling element and the driven shaft of the drive includes a coupling piece. The coupling element and the coupling piece each form one part of the coupling device, with the aid of which the drive shaft can be connected to the driven shaft of the drive.

According to the invention, it is provided that the coupling element of the drive shaft and the coupling piece of the driven shaft each include a form-locking element, with the aid of which the coupling element and the coupling piece engage into one another in a form-locking manner in the circumferential direction.

The maintenance of the opening roller and its drive in the open-end spinning device is enormously facilitated with the aid of the coupling device, which is preferably designed as a form-locking plug connection. A tool-less and time-efficient separation and connection of the coupling device is possible. Instead of a pure plug connection, a connection would also be possible, however, which is at least partially designed as a turn-lock fastener, for example, a bayonet lock. As a result, in addition to the torque transmission, an axial cohesion of the coupling device can also be achieved.

It is advantageous to design the opening roller according to the preceding description, wherein the aforementioned features can be present individually or in any combination. The aforementioned advantages apply correspondingly in this case for the open-end spinning device.

With respect to the open-end spinning device, it is also advantageous when the driven shaft of the drive and the drive shaft of the opening roller have a common rotational axis. This allows for a simple support of the shafts and permits a space-saving design perpendicularly to the shared rotational axis. Alternatively, the coupling device could also consist of gear wheels or of a gear wheel and a worm. Therefore, for example, a perpendicular arrangement of the rotational axes of the driven shaft and the drive shaft with respect to one another would be conceivable.

For the purpose of performing maintenance on the open-end spinning device, it is also advantageous when the coupling device can be released without a tool. This increases the efficiency of a maintenance operation on the opening roller and/or the drive.

According to one further embodiment of the open-end spinning device, it is advantageous when the coupling piece of the driven shaft is a component designed separately from the driven shaft. Preferably, the separate component is an attachment piece placed onto one end of the driven shaft. The attachment piece can be easily replaced in the event of wear, without the associated drive also needing to be replaced. In addition, conventional motors can be utilized for the single drive. The production of the coupling piece of the driven shaft is also facilitated by the manufacture as a separate attachment piece.

It is also advantageous with respect to the open-end spinning device when the coupling piece of the driven shaft, in particular, the attachment piece, includes an insertion bevel. This facilitates the assembly of the coupling device, in particular, when the coupling device is designed as a plug connection.

It is also conceivable, however, that the coupling element of the opening roller includes an insertion bevel in addition or alternatively to the insertion bevel of the coupling piece of the driven shaft.

According to one advantageous embodiment of the open-end spinning device, the drive shaft of the opening roller is supported in the open-end spinning device with the aid of a bearing unit. Depending on the length ratio of the driven shaft and the drive shaft, a support of the drive shaft is advantageous for the mechanical stability of the spinning device. In the case of a long driven shaft and a short drive shaft, the support of the driven shaft with the aid of the bearing unit would be possible as an alternative. In this case, the bearing unit could remain in the spinning device together with the drive when the opening roller is removed together with its drive shaft.

It is additionally advantageous for the open-end spinning device when the bearing unit by means of the coupling device can be separated from the driven shaft, and removed from the open-end spinning device, together with the drive shaft and the roller body. This is advantageous especially when the bearing unit is fixedly connected to the drive shaft. In this way as well, the bearing unit can be replaced or maintained independently of the drive.

It is advantageous in this case when the open-end spinning device includes an axial safety element for the bearing unit. For example, the safety element can be designed as a wire spring and can engage, in a form-locking manner, into a safety groove of the bearing unit. For this purpose, the wire spring can be situated in the open-end spinning device in such a way that it can be pivoted and tensioned.

It is further advantageous for the open-end spinning device when at least one further coupling device is formed between the drive and the opening roller. For example, it is possible, in this way, to perform maintenance on the bearing unit independently of the drive and independently of the opening roller.

BRIEF DESCRIPTION OF THE DRAWINGS

Further advantages of the invention are described in the following exemplary embodiments. Wherein.

DETAILED DESCRIPTION

Figure 1A:
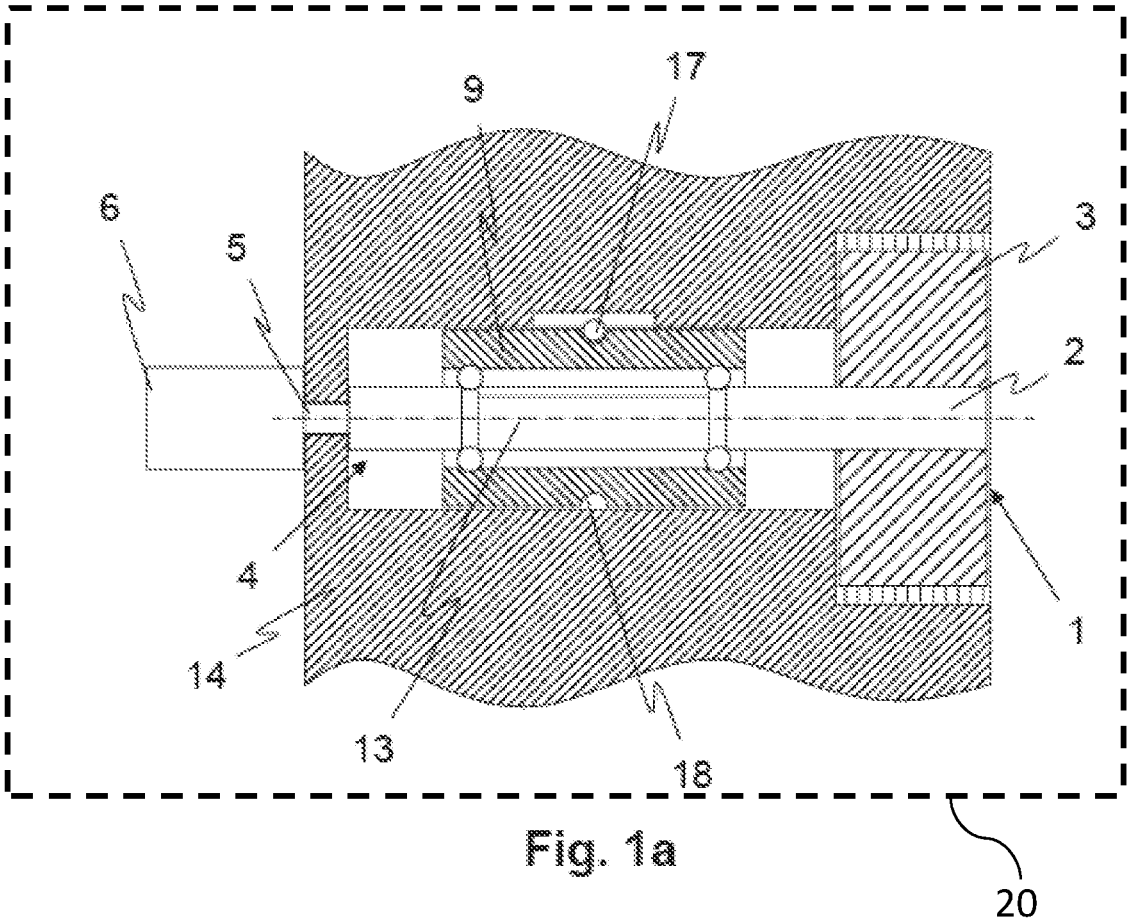
FIG. 1*a* shows a sectional representation of an opening roller which is connected to the driven shaft of a drive via a coupling device.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the figures, the same reference signs are utilized for identical and/or at least comparable features in each of the various figures. The individual features, their embodiment and/or mode of operation are explained in detail mostly only upon the first mention thereof. If individual features are not explained in detail once more, their embodiment and/or mode of operation correspond/corresponds to the embodiment and mode of operation of the features already described above.

As represented in FIG. 1*a*, an opening roller 1, which consists of a drive shaft 2 and a roller body 3, is connected via a coupling device 4 to a driven shaft 5 of a drive, which is designed as an electric single drive 6 in this case. The drive shaft 2 and the driven shaft 5 have a common rotational axis 13. The coupling device 4 consists of a coupling element 7 on the side of the opening roller 1 and of a coupling piece 11 on the side of the single drive 6 (see FIG. 1*b*). The drive shaft 2 of the opening roller 1 is supported with the aid of a bearing unit 9 in a pivotable cover element 14 of the open-end spinning device 20 (represented) schematically in FIG. 1*a* by the dashed line component. The bearing unit 9 is fixedly connected to the drive shaft 2 of the opening roller 1. If the opening roller 1 is to be replaced or maintained, the opening roller 1 can be removed from the open-end spinning device or the cover element 14 together with the bearing unit 9 by releasing the coupling device 4. For this purpose, the cover element 14 includes a receiving borehole for the bearing unit 9, into which the bearing unit 9 can be easily slid. With the aid of a safety element 17 of the open-end spinning device, such as a wire spring, a bracket, a set screw, or the like, the bearing unit 9 can be fixed in the cover element 14, in particular, in the axial direction, during operation. In the present case, the safety element 17 is designed as a wire spring which cooperates with a safety groove 18 of the bearing unit 9.

Figure 1B:
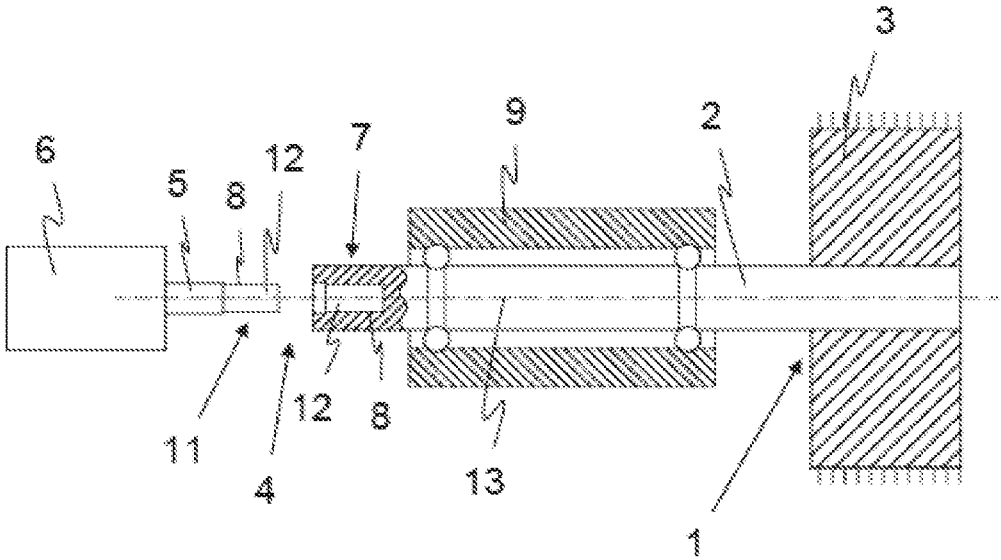
FIG. 1*b* shows a sectional representation of the aforementioned opening roller with a separated connection.

As is now shown in FIG. 1*b*, which shows the same components as in FIG. 1*a* with a separated coupling device 4, the coupling piece 11 as well as the coupling element 7 each include a form-locking element 8, and so the coupling device 4 is a form-locking plug connection. In this exemplary embodiment, the form-locking element 8 on the coupling element 7 and on the coupling piece 11 is designed as a semi-cylinder, as may also be gathered from FIG. 1*c*. Each of the form-locking elements 8 comprises a coupling surface 12 for torque transmission. The coupling surface 12 is oriented in the direction of the rotational axis 13 of the drive shaft 2.

Figure 1C:
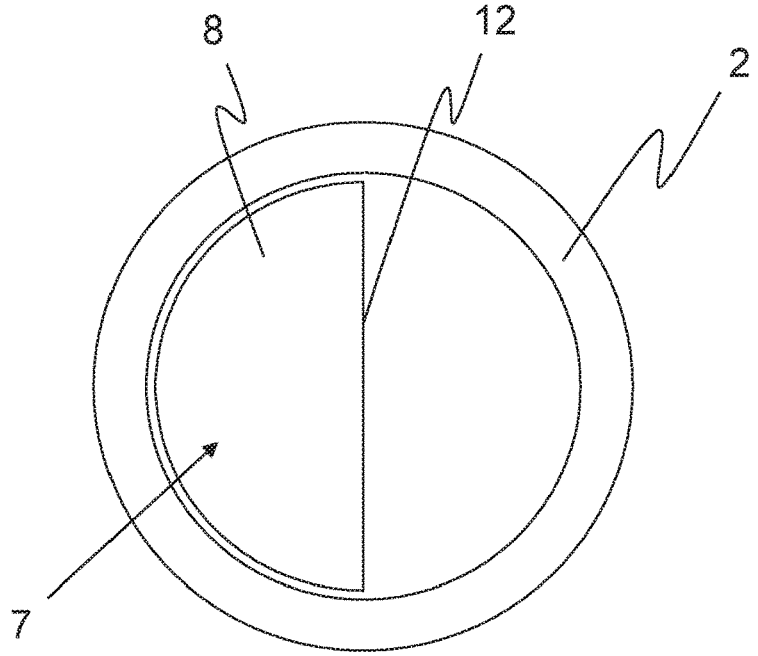
FIG. 1*c* shows a top view of the end of the drive shaft of the aforementioned opening roller.

FIG. 1*c* shows a top view of the end of the drive shaft 2. In this case, the drive shaft is provided, on the end thereof, with a borehole, into which the form-locking element 8, as a semi-cylindrical insert, has been inserted and fastened, for example, bonded or soldered therein. The plug connection with the aid of the coupling device 4 from this exemplary embodiment permits a form-locking and, therefore, slip-free torque transmission during operation of the opening roller 1 and a tool-less and, therefore, time-saving separation of the single drive 6 and the unit of the bearing unit 9 and the opening roller 1 for maintenance purposes.

Figure 2:
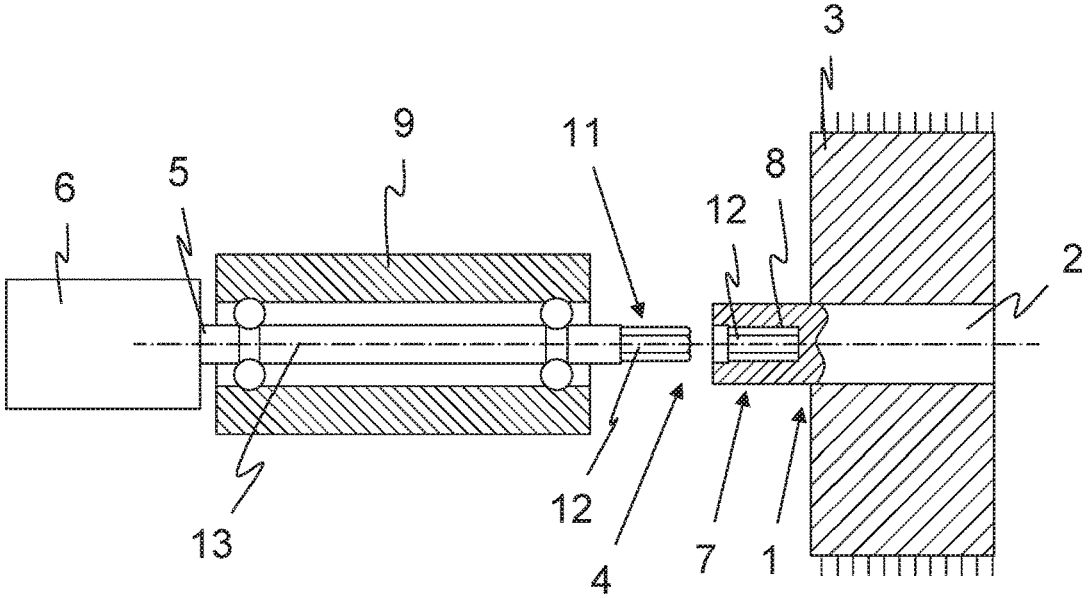
FIG. 2 shows a sectional representation of an opening roller comprising a short drive shaft, wherein the bearing unit is situated on the driven shaft of a single drive.

FIG. 2 shows an opening roller 1 comprising a short drive shaft 2. In this case, the bearing unit 9 is connected to the driven shaft 5 of the single drive 6. It is therefore possible to separate the opening roller 1, in an easy way, from the single drive 6 and the bearing unit 9 and to independently replace or maintain the opening roller 1. In this exemplary embodiment, the form-locking element 8 on the coupling element 7 is designed as a hexagon socket profile and on the coupling piece 11 as a hexagon insert profile, and so both form-locking elements 8 comprise multiple coupling surfaces 12. For the sake of clarity, only one of the coupling surfaces 12 is labeled in each case.

It is understood that each of the various aforementioned embodiments of the coupling device 4 or each of the various embodiments of the form-locking element 8 could be utilized in an alternative manner in each of the exemplary embodiments.

Figure 3:
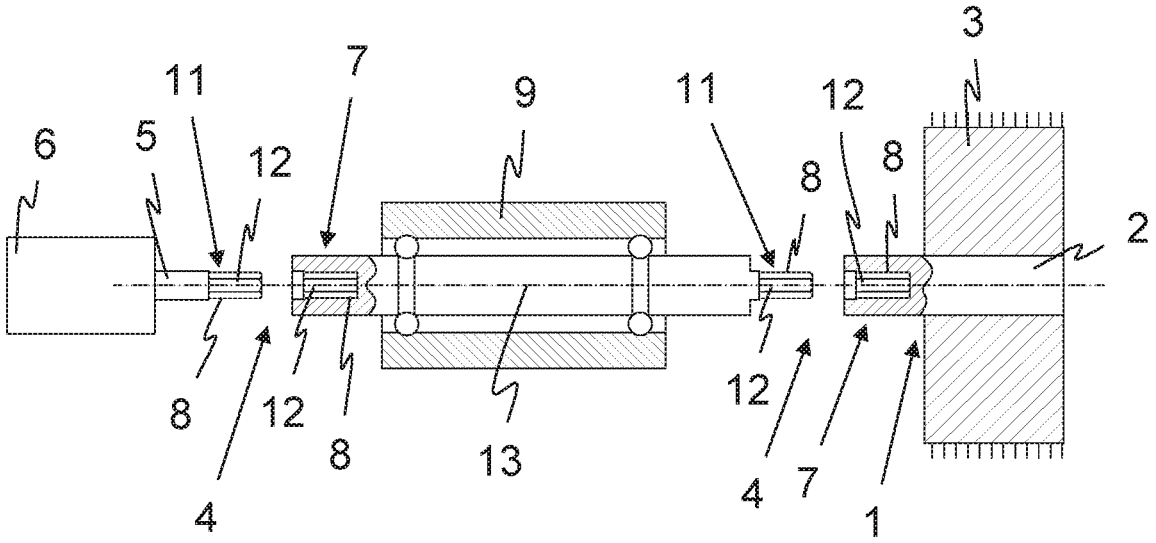
FIG. 3 shows a sectional representation of a system comprising an opening roller, a single drive, and a bearing unit including two separate coupling devices.

An embodiment comprising two coupling devices 4 along the common rotational axis 13 of the driven shaft 5 and the drive shaft 2 is represented in FIG. 3. The bearing unit 9 is located between the two coupling devices 4. Due to form-locking plug connections, the opening roller 1, the bearing unit 9, and, if necessary, the single drive 6 screwed into the open-end spinning device (not represented), can be replaced or maintained independently of one another.

Figure 4:
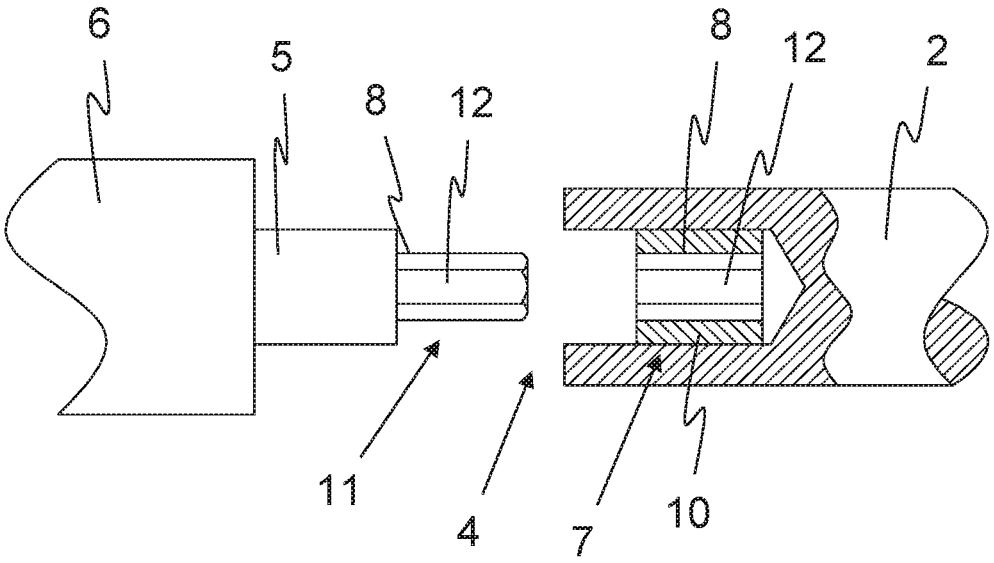
FIG. 4 shows an enlarged, truncated sectional representation of an embodiment of a coupling device comprising a receiving bush.

FIG. 4 shows the coupling device 4 between the driven shaft 5 and the drive shaft 2 as a combination of the coupling piece 11 and a separate receiving bush 10 as the coupling element. The receiving bush 10 is bonded into a borehole in the drive shaft 2 and is a separate component. The material of the receiving bush 10 can be appropriately adapted to the requirements in this way. Metals and their alloys, plastics, and ceramics are options, in particular. In the event that plastics or ceramics are utilized, the occurrence of fretting corrosion on the coupling surfaces 12 of the coupling piece 11 and the receiving bush 10 can be avoided. The receiving bush 10 can be replaced, as a wearing part, independently of the drive shaft 2. Depending on the load, it can be advantageous in this regard to provide the receiving bush 10 as well as the drive shaft 2 with a thread and to connect the two components with the aid of a screw connection.

Figure 5:
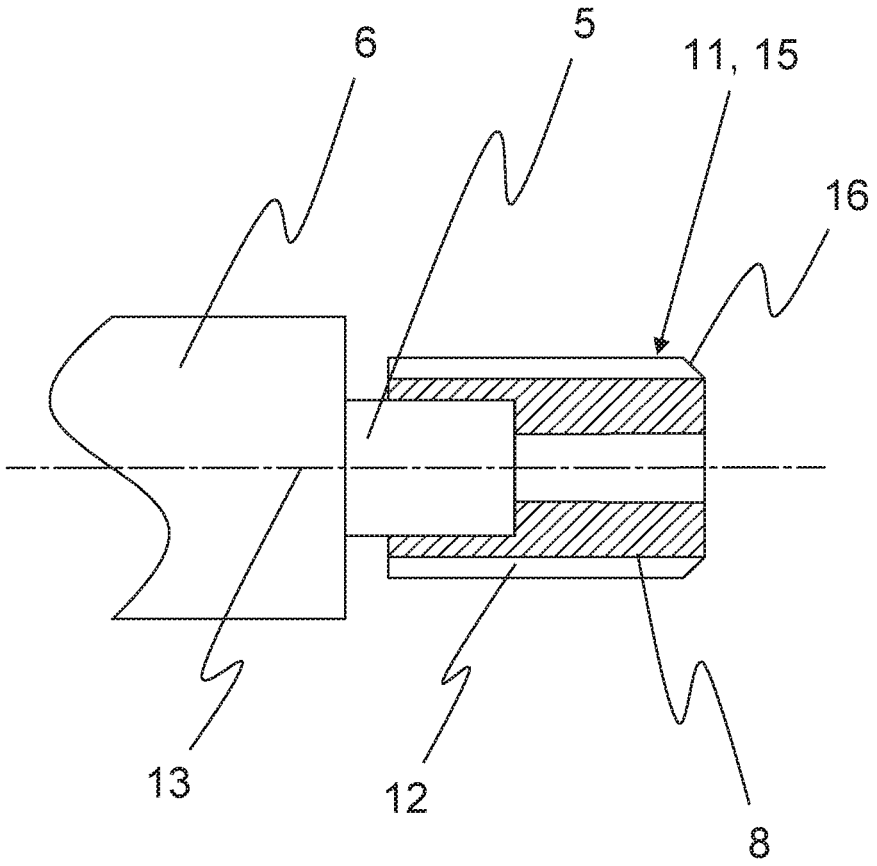
FIG. 5 shows an enlarged, truncated, partial cutaway view of an alternative embodiment of a coupling piece of a driven shaft comprising an attachment piece.

Moreover, FIG. 5 shows yet another advantageous embodiment of a coupling piece 11 of a driven shaft 5, in the case of which the coupling piece 11 is designed as an attachment piece 15. The attachment piece 15 is shown in a cutaway view in this case. The coupling piece 11 includes a multiple-toothed profile as the form-locking element 8 in this case. Other profiles, in particular, single- or multiple-cornered profiles, would also be conceivable, of course. The attachment piece 15 comprises an insertion bevel 16 in this case, which facilitates the coupling of the coupling device 4. It is understood that such an insertion bevel 16 can also be provided, alternatively or additionally, on the coupling element 7 of the drive shaft 2 of the opening roller 1 and is also advantageous, of course, in connection with form-locking elements 8 integrally formed directly on the drive shaft 2 or the driven shaft 5.

The present invention is not limited to the exemplary embodiments which have been represented and described. Modifications within the scope of the claims are also possible, as is any combination of the features, even if they are represented and described in different exemplary embodiments.

LIST OF REFERENCE CHARACTERS

1 opening roller
2 drive shaft
3 roller body
4 coupling device
5 driven shaft
6 single drive
7 coupling element
8 form-locking element
9 bearing unit
10 receiving bush
11 coupling piece
12 coupling surface
13 rotational axis
14 cover element
15 attachment piece
16 insertion bevel
17 safety element
18 safety groove
20 open-end spinning device

The invention claimed is:

1. An opening roller for an open-end spinning device, comprising:

a drive shaft;

a roller body connected to the drive shaft;

the drive shaft comprising a coupling element for connection to a driven shaft of a drive;

the coupling element comprises a form-locking element that connects with a coupling piece on the driven shaft of the drive;

the drive shaft configured to be supported in the open-end spinning device by a bearing unit that is separable from the driven shaft via the coupling piece such that the drive shaft with roller body and the bearing unit are removable together from the open-end spinning device.

2. The opening roller as in claim 1, wherein the form-locking element comprises at least one coupling surface oriented in an axial direction of the drive shaft and one of a single- or multiple-cornered profile, or a multiple-toothed profile.

3. The opening roller as in claim 1, wherein the drive shaft is fixedly connected to the bearing unit for supporting the drive shaft in the open-end spinning device.

4. The opening roller as in claim 3, the wherein a coupling surface of the form-locking element comprises a surface finishing.

5. The opening roller as in claim 1, wherein the coupling element is formed separately from and fixed to the drive shaft.

6. The opening roller as in claim 5, wherein the coupling element is replaceable independently of the drive shaft.

7. The opening roller as claim 5, wherein the coupling element and the drive shaft are formed from different materials.

8. An open-end spinning device, comprising:

an opening roller, the opening roller further comprising a drive shaft and a roller body connected to the drive shaft;

a drive for the opening roller, the drive further comprising a driven shaft;

a coupling device connecting the drive shaft of the opening roller and the driven shaft of the drive, the coupling device comprising a coupling element configured with the drive shaft of the opening roller and a coupling piece configured with the driven shaft of the drive;

wherein the coupling element and the coupling piece each comprise a complimentary form-locking element, the form-locking elements engaging one another in a circumferential direction of the opening roller;

wherein the drive shaft is supported in the open-end spinning device by a bearing unit; and wherein the bearing unit is separable from the driven shaft via the coupling device and is removable from the open-end spinning device together with the drive shaft and the roller body.

9. The open-end spinning device as in claim 8, wherein the drive comprises an electric drive stationarily situated in the open-end spinning device.

10. The open-end spinning device as in claim 8, wherein the driven shaft and the drive shaft comprise a common rotational axis.

11. The open-end spinning device as in claim 8, wherein the coupling device is configured for releasing without using a tool.

12. The open-end spinning device as in claim 8, wherein the coupling piece of the driven shaft is formed separately from and fixed to the driven shaft.

13. The open-end spinning device as in claim 8, further comprising a safety element for the bearing unit.

14. The open-end spinning device as in claim 8, further comprising an additional coupling device configured between the drive and the opening roller.

* * * * *